US011848521B2

(12) United States Patent
Stamm

(10) Patent No.: US 11,848,521 B2
(45) Date of Patent: Dec. 19, 2023

(54) PLUG CONNECTOR

(71) Applicant: Phoenix Contact GmbH & Co. KG, Blomberg (DE)

(72) Inventor: Sebastian Stamm, Brakel (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 227 days.

(21) Appl. No.: 17/296,562

(22) PCT Filed: Nov. 25, 2019

(86) PCT No.: PCT/EP2019/082403
§ 371 (c)(1),
(2) Date: May 25, 2021

(87) PCT Pub. No.: WO2020/109223
PCT Pub. Date: Jun. 4, 2020

(65) Prior Publication Data

US 2022/0029357 A1 Jan. 27, 2022

(30) Foreign Application Priority Data

Nov. 26, 2018 (BE) ..... 2018/5825

(51) Int. Cl.
*H01R 13/66* (2006.01)
*H01R 13/646* (2011.01)
*H01R 24/64* (2011.01)

(52) U.S. Cl.
CPC ..... *H01R 13/646* (2013.01); *H01R 24/64* (2013.01)

(58) Field of Classification Search
CPC ..... H01R 13/646; H01R 24/64
USPC ..... 439/620.22
See application file for complete search history.

(56) References Cited

U.S. PATENT DOCUMENTS 3,757,276 A * 9/1973 Kailus ..... H01R 24/40 439/886
4,094,574 A * 6/1978 Gunn ..... H01R 24/40 439/297
4,861,271 A * 8/1989 Bogar ..... H01R 24/545 439/675
5,055,068 A * 10/1991 Machura ..... H01R 24/50 439/581

(Continued)

FOREIGN PATENT DOCUMENTS

DE 102012100578 A1 7/2013

*Primary Examiner* — Abdullah A Riyami
*Assistant Examiner* — Vladimir Imas
(74) *Attorney, Agent, or Firm* — David S. Safran; Calderon Safran & Cole P.C.

(57) ABSTRACT

A plug connector (1) for connection of a data line, having a plug housing (2) with one or more connection elements (3) each connection element being for connection of a respective wire of the data line. The connection elements have one or more contact elements (4), and one or more conductor elements (5), via each of which a connection element (3) is electrically conductively connected to a contact element (4). Return damping of the plug connector (1) is reduced in that at least one portion (6) of the individual conductor elements (5) or at least one portion of the individual contact elements (4) is designed and arranged such that the wave impedance of the portion (6) is purposefully mismatched so that the value of the wave impedance deviates from the nominal wave impedance of the data line.

11 Claims, 4 Drawing Sheets

(56) References Cited

U.S. PATENT DOCUMENTS

| | | | | | |
|---|---|---|---|---|---|
| 5,074,804 | A * | 12/1991 | Pantland | H01R 13/665 | 439/136 |
| 5,453,026 | A * | 9/1995 | Ikegami | H01R 13/6585 | 439/98 |
| 5,516,294 | A * | 5/1996 | Andrews | H01R 24/50 | 439/63 |
| 6,045,402 | A * | 4/2000 | Embo | H01R 24/50 | 439/561 |
| 6,049,709 | A * | 4/2000 | Anderson | H04N 7/104 | 348/E7.053 |
| 8,821,195 | B2 * | 9/2014 | Ao | H01R 13/6473 | 439/682 |
| 8,961,229 | B2 * | 2/2015 | Pan | H01R 13/6587 | 439/931 |
| 9,345,128 | B2 * | 5/2016 | Regnier | H01R 13/6625 | |
| 9,520,676 | B1 * | 12/2016 | Chen | H01R 29/00 | |
| 9,905,973 | B2 * | 2/2018 | Schumacher | H05K 1/165 | |
| 10,840,650 | B2 * | 11/2020 | Winkler | H01R 29/00 | |
| 11,056,843 | B2 * | 7/2021 | Winkler | H01R 12/722 | |
| 2004/0203291 | A1 * | 10/2004 | Chen | H01R 12/716 | 439/676 |
| 2016/0079710 | A1 | 3/2016 | Schumacher | | |
| 2020/0091608 | A1 * | 3/2020 | Alpman | H01Q 25/001 | |

* cited by examiner

PLUG CONNECTOR

BACKGROUND OF THE INVENTION

Field of the Invention

The invention relates to a plug-in connector for connecting a data line, with a connector housing, with one or more connecting elements for connecting in each case one wire of the data line, with one or more contact elements and with one or more conductor elements, via which in each case one connecting element is connected in an electrically-conductive manner to a contact element.

Description of the Related Art

Plug-in connectors for connecting a data line to an electrical device, for example, a communication system, a computer, or a control unit, are known from experience in various variant embodiments. In this case, the data line is easily connected to the electrical device, in such a way that the data line is connected to the plug-in connector and the plug-in connector is connected to a corresponding mating plug-in connector on the electrical device. The plug-in connector that is connected to the data line is designed in most cases as a plug, while the mating plug-in connector that is designed on the electrical device is then designed as a receptacle.

In particular, in the electronic data processing (EDP) networks, RJ45 plugs and RJ45 jacks are frequently used as plug-in connectors, which serve to connect multi-wire, in particular 8-wire, data lines. Accordingly, such a plug-in connector then has eight connecting elements for connecting the eight individual wires of the data line, wherein in general, cutting contacts are provided as connecting elements. The individual connecting elements are connected in an electrically-conductive manner inside the plug housing via corresponding conductor elements to respectively one contact element. Alternatively, the individual wires of the data line can also be connected in pierce-connecting technology or crimp-connecting technology to the connecting elements of the plug-in connector or can be soldered to the latter. The contact elements serve to create the electrical connection with corresponding mating contact elements in the mating plug-in connector; to do this, the contact elements are accessible from a front side of the connector housing.

In principle, it is also possible that the plug-in connector is provided for connecting a data line that has only one wire. Such a data line can be, for example, an antenna cable or a coaxial cable. The plug-in connector must then accordingly also have only one connecting element, one conductor element, and one contact element.

Regardless of the actual configuration of the plug-in connector, i.e., both in the case of the above-described RJ45 plug-in connectors and in the case of other plug-in connectors, such as, for example, circular plug-in connectors, the problem exists that the signals to be transmitted can be accidentally altered by the plug-in connectors. The behavior of a plug-in connector relative to the signal transmission is described by its transmission properties. An important transmission property is in this case the return loss, which is in part also referred to as backscatter loss.

The return loss is a measure of reflection, i.e., of the ratio of reflected power to the emitted power, denoted in general as a logarithmic measurement in decibels (dB). As a result of a portion of the emitted energy flowing back toward the emitter by reflections, disruptions occur in signal transmission. Such backscatter or reflections occur at inhomogeneities inside the line and the plug-in connector. In general, inhomogeneities occur overall where the characteristic wave impedance changes, i.e., in particular, at points of contact and transitions between components that have different characteristic wave impedances. This means that disruptive reflections can be avoided in such a way that the characteristic wave impedances of all components and conductor sections are identical in a transmission path. If this is the case, this is referred to as a match. If, however, the characteristic wave impedances of the individual components and conductor sections are not identical in a transmission path, this is referred to as a mismatch.

In practice, the characteristic wave impedances of various transmission technologies are fixed or standardized. In many EDP networks, the characteristic wave impedance is in this case 100 Ohm. Therefore, in general, all components in such a network, such as in particular plug-in connectors, are configured or adapted to this characteristic wave impedance, which is referred to as a rated characteristic wave impedance.

Based on structural conditions in a plug-in connector and other restrictions that exist in the case of plug-in connectors, it is only conditional in practice, however, that the path of the characteristic wave impedance inside the entire plug-in connector corresponds to the desired rated characteristic wave impedance. Due to a preset plug configuration, for example, the contact elements must be a preset distance apart, which can result in an alteration in the characteristic wave impedance in the area of the contact elements.

In practice, therefore, areas inside a plug-in connector, which allow a large free space for configuration, for example, sections of the conductor elements, are configured as exactly as possible for the rated characteristic wave impedance. In the sections, however, in which it is not possible to maintain the rated characteristic wave impedance because of structural conditions or other restrictions, a deviating characteristic wave impedance that arises is accepted as a random mismatch.

Known from German Patent DE 10 2012 100 578 B4 is a conductor plate for a plug-in connector, which has additional strip conductor sections for adapting the overall characteristic wave impedance of the conductor plate, which sections form an additional inductive or capacitive component, thereby ensuring that the characteristic wave impedance can be raised or lowered in this area. In this way, an attempt is made to adapt the overall characteristic wave impedance via the conductor plate to the required rated characteristic wave impedance or to readapt the impedance path inside the plug-in connector as much as possible after each deviation to the rated characteristic wave impedance.

In this case, it is disadvantageous, however, that because of the additional strip conductor structures, additional space is required inside the plug-in connector, thereby limiting the size of the compensation measure. In addition, the inductive or capacitive components that are created by the additional strip conductor structures themselves represent additional points of contact, which reduce their compensation action because of reflections that occur at these points of contact. Finally, the additional strip conductor structures must maintain very narrow tolerance thresholds, so that the desired compensation action actually occurs, which is connected to corresponding production costs.

SUMMARY OF THE INVENTION

The object of this invention is therefore to indicate the simplest possible, but still effective, way in which undesirable reflections in a plug-in connector can be reduced, so that the requirements on the return loss of the plug-in connector can still be met.

This object is achieved in the case of the plug-in connector as described in the introduction, in such a way that at least one section of the individual conductor elements or at least one section of the individual contact elements is designed and arranged so that the characteristic wave impedance of the section is specifically mismatched by the value of the characteristic wave impedance deviating from the rated characteristic wave impedance of the data line. Unlike as practiced previously in the state of the art, where conductor sections that allow a large free space for configuration have been configured as exactly as possible to the rated characteristic wave impedance, at least sections of the individual conductor elements or of the individual contact elements are now configured so that there is a targeted mismatch. Because of the mismatch in the area of the plug-in connector, in which a free space for configuration is present, i.e., there are only a few restrictions, if any, the mismatches can thus be compensated for in other areas of the plug-in connector or at least are decreased overall.

If the plug-in connector is equipped for connecting a data line with only one wire, so that the plug-in connector also has only one connecting element, one contact element, and one conductor element, at least one section of the conductor element or at least one section of the contact element is thus specifically mismatched with respect to its characteristic wave impedance. Without the invention being supposed to be limited thereto, however, below it is always assumed that the data line has multiple wires and, corresponding to the plug-in connector, also multiple connecting elements, contact elements, and conductor elements.

If the plug-in connector according to the invention is provided, for example, for use in EDP networks, in which the rated characteristic wave impedance is 100 Ohm, at least one section of the individual conductor elements or one section of the individual contact elements is designed and arranged so that the value of the characteristic wave impedance of the section deviates from 100 Ohm. If, for example, capacitors are provided in the plug-in connector for ensuring the necessary transmission properties, this leads to a decrease in the characteristic wave impedance in this area. In such a case, at least one section of the individual conductor elements was then configured according to this invention so that its characteristic wave impedance is accordingly greater than 100 Ohm in order to compensate for the decrease in the characteristic wave impedance by the capacitors if possible. If, however, multiple inductivities are arranged in a plug-in connector in one section, by which the characteristic wave impedance in this area is increased, at least one section of the individual conductor elements was thus adapted according to the invention so that the characteristic wave impedance in the section is accordingly less than 100 Ohm.

It was previously stated that at least one section of the individual conductor elements or at least one section of the individual contact elements is designed and arranged so that the characteristic wave impedance of the section is specifically mismatched. The targeted mismatch can thus be created both in the area of the individual conductor elements and in the area of the contact elements. In both cases, preferably the width and/or the thickness of the conductor element or the contact element can be increased or decreased at least in the section, in each case in proportion to the width or thickness of a corresponding conductor element or contact element with rated characteristic wave impedance.

According to another advantageous configuration of the invention, the distance between the sections of two conductor elements or two contact elements can be increased or decreased accordingly, in proportion to the distance between two conductor elements or two contact elements with rated characteristic wave impedance.

Starting from the basic consideration of this invention of configuring the characteristic wave impedance in at least one section of the individual conductor elements or the individual contact elements in a specifically mismatched manner, one skilled in the art can take into consideration, in the actual configuration, that the characteristic wave impedances of both the conductor elements and the contact elements depend on the geometry and material parameters thereof. Therefore, a targeted mismatch can be achieved by multiple design measures, wherein the individual measures can be implemented both alternatively and cumulatively.

The characteristic wave impedance of a coupled microstrip line depends on, for example, the conductor width w and the conductor thickness t of the individual microstrip lines. A reduction in the conductor width w in this case just like a reduction in the conductor thickness t leads to an increase in the characteristic wave impedance, wherein, however, the influence of the conductor width w is greater. Accordingly, increasing the conductor width w and increasing the conductor thickness tin each case leads to a reduction in the characteristic wave impedance of the strip line. Moreover, the characteristic wave impedance of a coupled microstrip line also depends on the distance s between the two lines. Decreasing the distance s in this case leads to a decrease in the characteristic wave impedance, while increasing the distance s leads to an increase in the characteristic wave impedance.

Based on corresponding equations for the conductor elements or the contact elements that are provided in each case in the plug-in connector, one skilled in the art can thus determine with adequate accuracy what effect a corresponding alteration of the above-mentioned geometry parameters has on the characteristic wave impedance of the conductor elements or the contact elements. In the case of a plug-in connector, which has, for example, pin contacts as contact elements, a mismatch of the characteristic wave impedance in the area of the contact elements can thus be performed in a targeted manner in such a way that the diameter of the contact elements and/or the distance between two contact elements is altered accordingly.

According to an especially preferred configuration of the invention, at least one conductor plate is provided in the connector housing of the plug-in connector, which plate has multiple strip conductors as conductor elements. The conductor plate can in this case be both a rigid conductor plate and one or more flexible conductor plates that are arranged above one another. In the case of such a plug-in connector with a conductor plate, at least one section of the individual strip conductors is then advantageously specifically mismatched. The section can in this case comprise either only one part of the respective strip conductor or the entire strip conductor can also be specifically mismatched over its entire length, i.e., for example, the width w of the strip conductor can be selected to be smaller than was the case in an adaption to the rated characteristic wave impedance.

In the case of plug-in connectors with a conductor plate, the latter preferably have at least one ground surface, so that the individual strip conductors in each case are at a certain distance h from the ground surface. According to a configuration of the invention, the targeted mismatch of the characteristic wave impedance of the strip conductor can then also be achieved in such a way that at least in one section of the strip conductor, the distance between the section and the ground surface is increased or decreased, in proportion to the distance between the section and the ground surface of a corresponding strip conductor with rated characteristic wave impedance. Decreasing the distance from the ground surface in this case leads to a reduction in the characteristic wave impedance, while increasing the distance also yields a greater characteristic wave impedance.

It was previously stated that because of the targeted mismatch of one section of individual strip conductors on a conductor plate, the mismatch of the characteristic wave impedance, unavoidable because of other restrictions, is to be compensated for in another area of the conductor plate. Preferably, in this case, a targeted mismatch of at least one section of all strip conductors of the conductor plate is achieved. Regardless of this, however, it is also conceivable that a targeted mismatch is performed only on individual strip conductors, in particular when in the case of other strip conductors, the impedance path deviates little or not at all from the rated characteristic wave impedance over the entire length of the plug-in connector.

In the case of a plug-in connector for connecting a data line, via which signals are to be transmitted in an EDP network, it is often necessary that to improve the transmission properties, capacitors that are arranged at certain points on the conductor plate are used. The use of the necessary capacitors leads to the characteristic wave impedance of the strip conductors being reduced in this area. In the case of a plug-in connector with a conductor plate, on which multiple capacitors are arranged, it is therefore provided according to an especially preferred configuration of the invention that the individual strip conductors at least in one section have a decreased width and/or an increased distance h from the ground surface of the conductor plate. Both measures have the effect that the characteristic wave impedance of the section is increased, so that the reduction in the characteristic wave impedance that is caused by the capacitors can be at least partially compensated.

Reducing the width w of a strip conductor by, for example, 20% in this case leads to an increase in the characteristic wave impedance by just below 10%, and increasing the distance h between the strip conductor and the ground surface by 20% leads to an increase in the characteristic wave impedance by approximately 5%. Increasing the distance between the section of a strip conductor and the ground surface can in this case, for example, be ensured in a simple way by ensuring that the ground surface has corresponding recesses or cutouts in the area of the desired section of the strip conductor, thereby ensuring that the distance between the strip conductor and the ground surface can be increased accordingly. Thus, one skilled in the art can create a targeted mismatch of a section of the strip conductor by a corresponding combination of the above-described measures and based on the options that exist in the case of a conductor plate, i.e., can increase the characteristic wave impedance of the strip conductor in this section, by which overall, the return loss of the entire strip conductor and thus also of the plug-in connector can be improved.

An alternative or additional measure for increasing the characteristic wave impedance of the section of two adjacent strip conductors consists in increasing the distance s between the sections of the two adjacent strip conductors. In this case, increasing the distance s by, for example, 20% causes the characteristic wave impedance to be increased by approximately 5%. Depending on which free space for configuration relative to the position of the strip conductors exists on a conductor plate, the geometry parameters of the strip conductors can thus be specifically altered individually or in combination in order to achieve the desired mismatch of the characteristic wave impedance, i.e., a characteristic wave impedance that deviates from the rated characteristic wave impedance.

Various preferred measures were described above, in which by altering various geometry parameters, an increase in the characteristic wave impedance of a section of the strip conductor or the entire strip conductor can be created. These measures can accordingly be applied even when a mismatch toward a smaller characteristic wave impedance is desired, since the characteristic wave impedance of the strip conductors—because of certain conditions, for example, inductive properties of contact elements—is increased beyond the rated characteristic wave impedance. In such a case, according to a preliminary configuration of the invention, it is provided that the width w of the individual strip conductors is increased at least in one section and/or the distance h between the section of the individual strip conductors and the ground surface is decreased. Increasing the width w of the individual strip conductors by, for example, 20%, leads to a decrease in the characteristic wave impedance by approximately 10%, and decreasing the distance h between the section of the strip conductor and the ground surface also by 20% leads to a decrease in the characteristic wave impedance by a good 5%. Also, in this case, the above-described measures can be carried out both individually and in combination.

Another option for decreasing the characteristic wave impedance of two strip conductors by a specific mismatch consists in that the distance s between the sections of two adjacent strip conductors is decreased. Decreasing the distance s by 30% leads to a decrease in the characteristic wave impedance by approximately 10%. Also, this measure can be carried out either by itself or together with the above-described measures, depending on how large the desired mismatch is to be and which geometry parameters of the strip conductor can be most easily altered in the actual case.

In the introduction, it was stated that at least one section of the individual strip conductors is designed and arranged so that the characteristic wave impedance of the section is specifically mismatched. Instead of the mismatch of only one section of the strip conductor, it is in principle also possible to design the strip conductor accordingly over its entire length, i.e., for example, to decrease its width over the entire length. Since strip conductors are in general—or, due to spatial conditions, have to be—arranged on a conductor plate in such a way that they also have bends in addition to straight sections, it can be advantageous to alter the characteristic wave impedance only in the sections of the individual strip conductors, so that it deviates from the rated characteristic wave impedance, which does not have any bends. In this case, it is especially advantageous when only those strip conductor sections in which at least two strip conductors run parallel to one another can be specifically altered with respect to their geometry parameters. In this way, it is possible to avoid additional determining factors that can be caused by, for example, differing strip conductor lengths or bends.

In particular, there are multiple options for configuring and further developing the plug-in connectors according to the invention. To this end, reference is made to the subsequent description of two preferred embodiments in connection with the drawings.

DETAILED DESCRIPTION OF THE INVENTION

Figure 1:
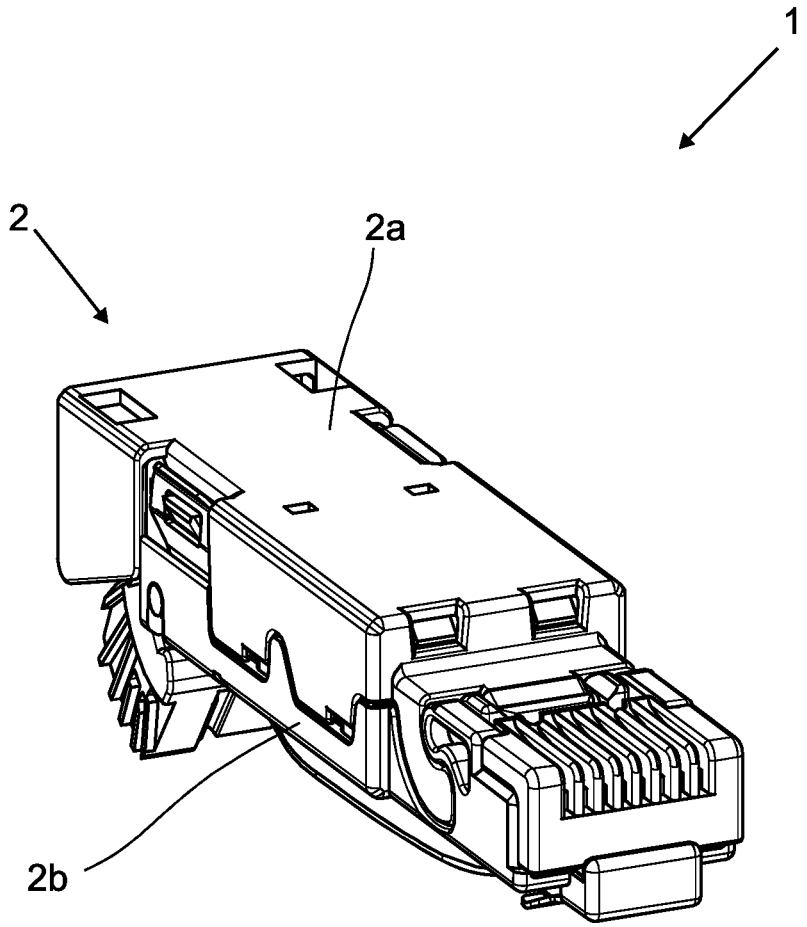
FIG. 1 is a perspective view of a plug-in connector.
Figure 2:
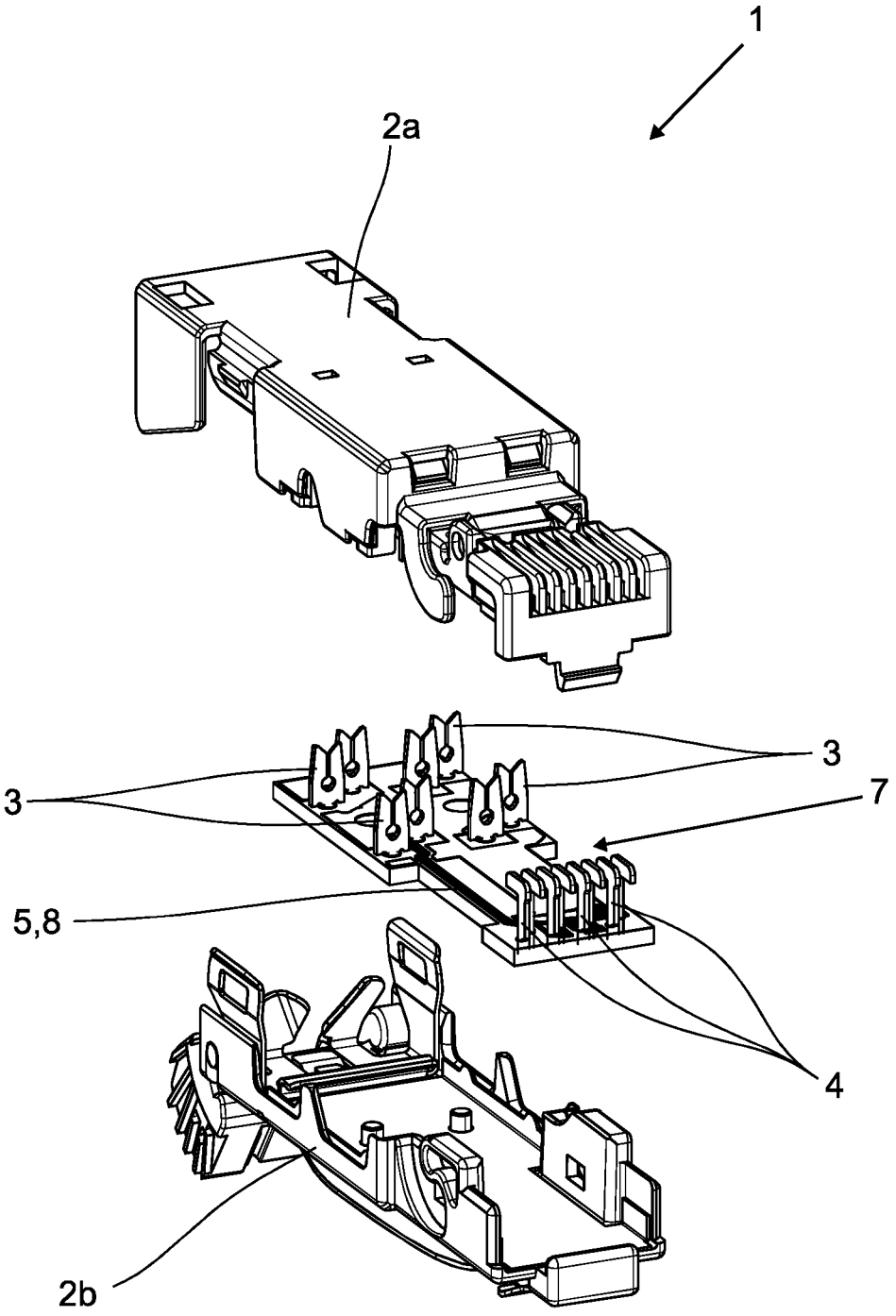
FIG. 2 is an exploded view of the plug-in connector according to FIG. 1.

FIGS. 1 and 2 show an embodiment of a plug-in connector 1 according to the invention, which in this case is designed as an RJ45 plug-in connector, which can be fabricated in the field. In this case, FIG. 1 shows the plug-in connector 1 in the assembled state—but without a data line connected to the plug-in connector 1—while FIG. 2 shows an exploded view of the plug-in connector 1. The plug-in connector 1 has a two-part housing 2 with a housing upper part 2*a* and a housing lower part 2*b*. Inside the housing 2, a total of eight connecting elements 3, which are designed here as cutting contacts, and eight contact elements 4 are arranged, wherein in each case, a connecting element 3 is connected in an electrically-conductive manner via a conductor element 5 to a contact element 4. The contact elements 4 are arranged and designed corresponding to corresponding mating contact elements of a jack, not shown here, into which jack the plug-in connector 1 that is designed as a plug can be inserted.

In the case of the plug-in connector 1 according to the invention, in each case at least one section 6 of the individual conductor elements 5 is designed and arranged in such a way that the characteristic wave impedance of the section 6 is specifically mismatched. This means that the value of the characteristic wave impedance in the section 6 deviates from the rated characteristic wave impedance of the data line, which is to be connected to the plug-in connector 1. In the case of data lines in the EDP networks, the rated characteristic wave impedance is in general 100 Ohm, so that the corresponding sections 6 of the individual conductor elements 5 in each case have a characteristic wave impedance that is greater than or less than 100 Ohm. In the case of the embodiment of the plug-in connector 1 that is depicted in the figures, the connecting elements 3 and the contact elements 4 are arranged on a conductor plate 7, which has multiple strip conductors 8 as conductor elements 5. The conductor plate 7 that is depicted in FIG. 2 is in this case a multi-layer conductor plate, which has a total of four thicknesses or layers, wherein in FIG. 2, only the upper layer of the conductor plate 7 is visible.

Figure 3:
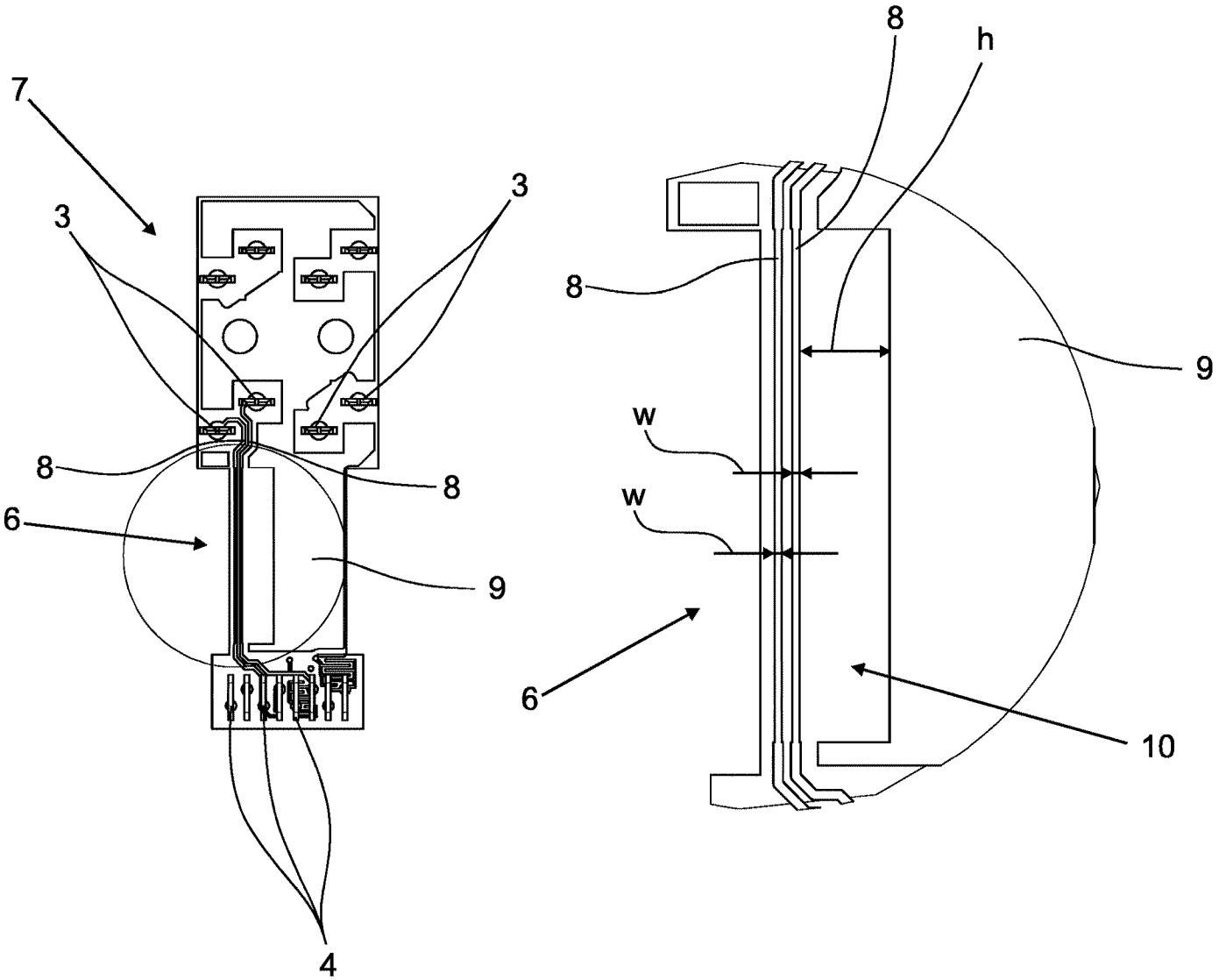
FIG. 3 is an enlarged view of a detail of the first embodiment of a conductor plate of a plug-in connector.
Figure 4:
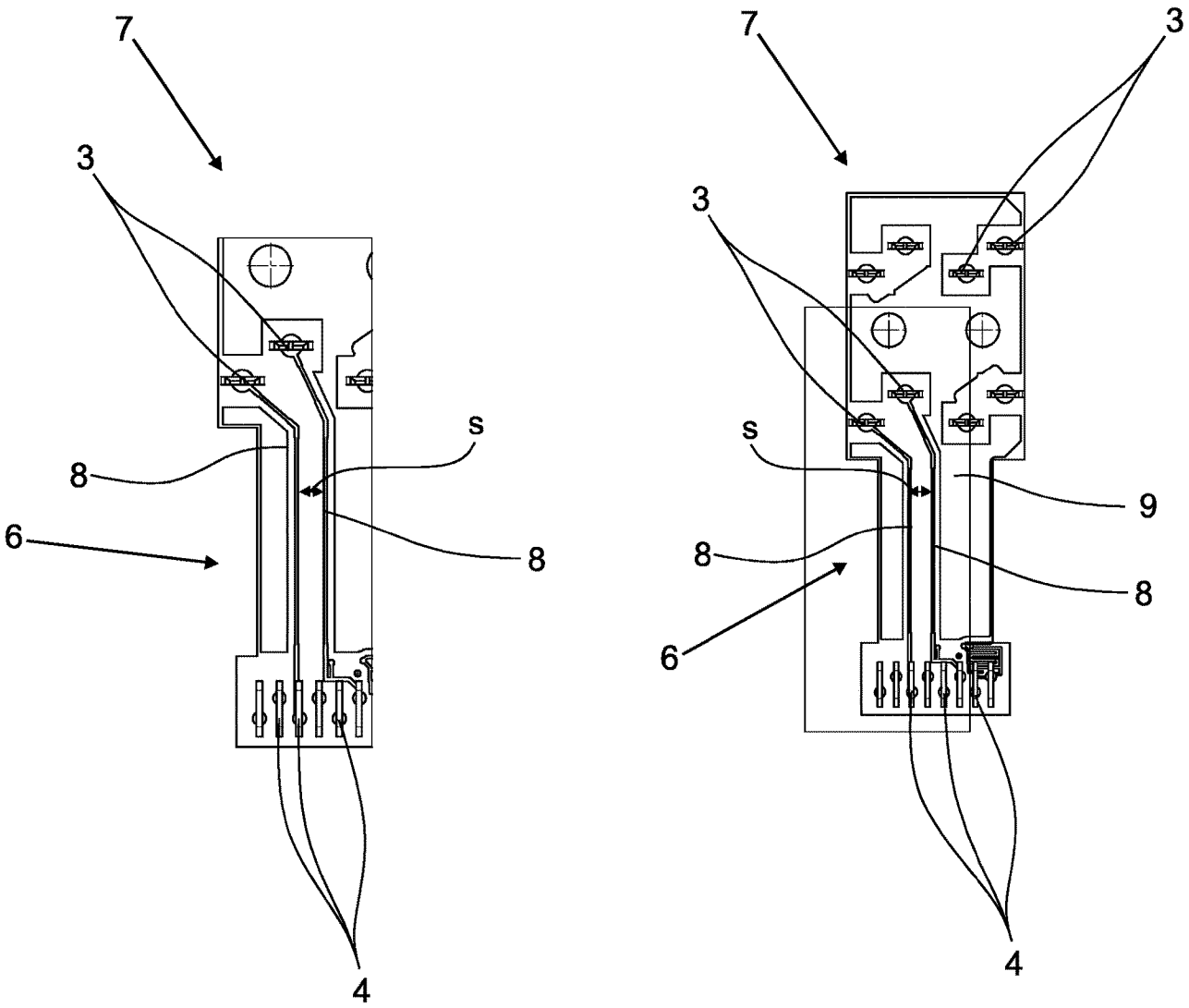
FIG. 4 is an enlarged view of a detail of a second embodiment of a conductor plate of a plug-in connector.

FIGS. 3 and 4 show two different embodiments of the uppermost layer of the conductor plate 7 that is depicted in FIG. 2, once as an overall view and once as an enlarged detailed depiction. In addition to the strip conductors 8 that are arranged on the top of the conductor plate 7 or the uppermost layer of the conductor plate 7, the individual layers of the conductor plate 7 in each case still have a ground surface 9, which is arranged below the strip conductors 8 and is separated from the strip conductors 8 by the corresponding base material of the conductor plate 7.

The individual strip conductors 8 can be identified in particular by their geometry parameters, which are altered for targeted mismatch of the characteristic wave impedance in the section 6.

In the case of the embodiment depicted in FIG. 3, in section 6, the widths w of the two strip conductors 8 are decreased, in proportion to the width of a corresponding strip conductor with rated characteristic wave impedance. As a result, the characteristic wave impedance of the section 6 of the strip conductors 8 is greater than the rated characteristic wave impedance, i.e., in this case is greater than 100 Ohm. In addition, in the case of the embodiment depicted in FIG. 3, the distance h between the sections 6 of the two strip conductors 8 and the ground surface 9 is increased; to do this, a corresponding cutout 10 is made in the ground surface 9. Also, increasing the distance h between the sections 6 and the ground surface 9 leads to an increase in the characteristic wave impedance of the sections 6 of the strip conductors 8, so that because of the two above-described measures, the two strip conductors 8 in the area of their sections 6 in each case have a characteristic wave impedance that is, for example, approximately 15% to 20% above the rated characteristic wave impedance.

In the case of the second embodiment of a conductor plate 7 that is depicted in FIG. 4, the characteristic wave impedance of the sections 6 of the strip conductors 8 is also increased in comparison to the rated characteristic wave impedance. For this purpose, in the case of the embodiment according to FIG. 4, the distance s between the two sections 6 of the two strip conductors 8 that run parallel to one another is increased relative to a match with the rated characteristic wave impedance. This measure can, as depicted in FIG. 4, be carried out together with a reduction in the width w of the two strip conductors 8 in the section 6 or can be carried out as an alternative to the two measures that are depicted in FIG. 3. In principle, it is also possible to combine all measures with one another.

Another option for altering the characteristic wave impedance of a section 6 of a strip conductor 8 consists in decreasing or increasing the thickness t of the strip conductor 8. In this case, decreasing the thickness t leads to an increase in the characteristic wave impedance, while increasing the thickness t of the strip conductors leads to a decrease in the characteristic wave impedance. The influence of an alteration of the thickness t of the strip conductor on the characteristic wave impedance is, however, less than the influence of an alteration of the width w of the strip conductor. Since, moreover, the manufacturing tolerances for the conductor thicknesses are relatively large, this option of targeted mismatch of the characteristic wave impedance of a strip conductor 8 is in general less well-suited, and in practice thus less simple to implement.

Finally, it is also evident from FIGS. 3 and 4 that in the case of the two variant embodiments, the sections 6 in the strip conductors 8 can be selected so that the strip conductors 8 run parallel to one another there and do not have any bends. This has the advantage that, as a result, it is possible to avoid further influences on the characteristic wave impedance of the individual strip conductors, which can arise by varying conductor lengths or by the bends.

What is claimed is:

1. A plug-in connector for connecting a data line, with a connector housing, with one or more connecting elements for connecting in each case one wire of the data line, with one or more contact elements and with one or more conductor elements, via which each of the connecting elements is connected in an electrically-conductive manner to a respective one of the contact elements, wherein at least one section of each of the one or more conductor elements or at least one section of each of the individual contact elements is configured and arranged so that a characteristic wave impedance of the section is specifically mismatched by a value of the characteristic wave impedance that deviates from a rated characteristic wave impedance of the data line, and wherein, because of the mismatch in the area of the plug-in connector, in which a free space for configuration is present with only a few restrictions, if any, the mismatch can be compensated for in areas other than said at least one section or at least are decreased overall.

2. The plug-in connector according to claim 1, wherein in the at least one section, a width (w) and/or a thickness (t) of the individual conductor elements or the individual contact elements is increased or decreased, in proportion to the width (w) and/or the thickness (t) of a corresponding conductor element or contact element with rated characteristic wave impedance.

3. The plug-in connector according to claim 1, wherein a distance (s) between the sections of two of the conductor elements or two of the contact elements is increased or decreased, in proportion to the distance (s) between two conductor elements or two contact elements with rated characteristic wave impedance.

4. The plug-in connector according to claim 1, wherein a conductor plate is provided which has multiple strip conductors as conductor elements.

5. The plug-in connector according to claim 4, wherein the conductor plate has a ground surface wherein the distance (h) between the section of the individual strip conductors and the ground surface is increased or decreased, in proportion to the distance (h) that exists between a corresponding strip conductor with rated characteristic wave impedance and the ground surface.

6. The plug-in connector according to claim 5, wherein capacitors are arranged on the conductor plate, wherein the individual strip conductors at least in one section have a decreased width (w) and/or an increased distance (h) from the ground surface.

7. The plug-in connector according to claim 4, wherein a conductor plate is provided which has multiple strip conductors arranged thereon as conductor elements and wherein capacitors are arranged on the conductor plate, and wherein the distance (s) between the sections of two adjacent strip conductors is increased relative to a match with the rated characteristic wave impedance for producing an increase in the characteristic wave impedance.

8. The plug-in connector according to claim 4, wherein the conductor plate has a ground surface and wherein at least one section of the individual strip conductors has an increased width (w) and/or a decreased distance (h) from the ground surface.

9. The plug-in connector according to claim 4, wherein a conductor plate is provided which has multiple strip conductors arranged thereon as conductor elements, and wherein the distance (s) between the sections of two adjacent strip conductors is decreased relative to a match with the rated characteristic wave impedance for producing a decrease in the characteristic wave impedance.

10. The plug-in connector according to claim 4, wherein the section of the individual strip conductors whose characteristic wave impedance deviates from the rated characteristic wave impedance of the data line runs parallel to at least one section of a strip conductor that is arranged alongside.

11. The plug-in connector according to claim 1, wherein the plug-in connector is an RJ45 plug-in connector.

* * * * *